US009752301B2

(12) United States Patent
Ruhl et al.

(10) Patent No.: US 9,752,301 B2
(45) **Date of Patent: *Sep. 5, 2017**

(54) TRENCHING SYSTEM

(71) Applicant: The Charles Machine Works, Inc., Perry, OK (US)

(72) Inventors: Michael C. Ruhl, Stillwater, OK (US); David R. Bazzell, Perry, OK (US); Vernon T. Stellman, Stillwater, OK (US); Steven P. Seabolt, Perry, OK (US); Andrew S. Schuermann, Perry, OK (US)

(73) Assignee: The Charles Machine Works, Inc., Perry, OK (US)

( * ) Notice: Subject to any disclaimer, the term of this patent is extended or adjusted under 35 U.S.C. 154(b) by 58 days.

This patent is subject to a terminal disclaimer.

(21) Appl. No.: 14/459,128

(22) Filed: Aug. 13, 2014

(65) Prior Publication Data

US 2014/0345169 A1 Nov. 27, 2014

Related U.S. Application Data

(63) Continuation of application No. 13/758,233, filed on Feb. 4, 2013, now Pat. No. 8,806,784, which is a (Continued)

(51) Int. Cl.
*E02F 5/08* (2006.01)
*E02F 3/18* (2006.01)

(Continued)

(52) U.S. Cl.
CPC ..... *E02F 5/08* (2013.01); *E02F 3/183* (2013.01); *E02F 3/188* (2013.01); *E02F 3/241* (2013.01);

(Continued)

(58) Field of Classification Search
CPC ... E02F 3/183; E02F 3/188; E02F 3/20; E02F 5/08; E02F 5/10; E02F 5/12; E02F 3/241; E02F 3/246; E02F 3/9212; E02F 5/101
See application file for complete search history.

(56) References Cited

U.S. PATENT DOCUMENTS 4,221,505 A 9/1980 Taylor-Smith
4,326,347 A 4/1982 Ballinger (Continued)

FOREIGN PATENT DOCUMENTS

FR 1386111 A 1/1965
FR 2749866 A1 12/1997
WO 0123677 A1 4/2001

OTHER PUBLICATIONS

European Patent Office, "Supplementary European Search Report", Mar. 16, 2017, 3 pages, Munich, Germany.

*Primary Examiner* — Jamie L McGowan
(74) *Attorney, Agent, or Firm* — Tomlinson McKinstry, P.C.

(57) ABSTRACT

A system for uncovering and sealing a narrow trench. The system comprises several subsystems, including a work machine, a frame for providing a seal with the surface to be trenched, a saw blade, a vacuum system, a system for placing product, and a resealer. The blade includes rotatable tooth bits, which may be rotated and secured to create a blade for narrower or a wider trench. A removable cover and the blade are easily changeable. A surface engaging member on the frame is manipulated to maintain a seal with changing ground surfaces. Additionally, the vertical location of the blade within the frame is adjustable to create a deeper or shallower trench.

25 Claims, 7 Drawing Sheets

Related U.S. Application Data continuation of application No. 12/842,799, filed on Jul. 23, 2010, now Pat. No. 8,375,605.

(60) Provisional application No. 61/353,984, filed on Jun. 11, 2010, provisional application No. 61/227,935, filed on Jul. 23, 2009.

(51) Int. Cl.

| | |
|---|---|
| ***E02F 3/24*** | (2006.01) |
| ***E02F 3/92*** | (2006.01) |
| ***E02F 5/10*** | (2006.01) |
| ***E02F 5/12*** | (2006.01) |

(52) U.S. Cl.

CPC ..... *E02F 3/246* (2013.01); *E02F 3/9212* (2013.01); *E02F 5/101* (2013.01); *E02F 5/12* (2013.01)

(56) References Cited

U.S. PATENT DOCUMENTS

| | | | | |
|---|---|---|---|---|
| 4,768,297 | A | 9/1988 | Rivard | |
| 4,794,709 | A | 1/1989 | Rivard | |
| 4,812,078 | A | 3/1989 | Rivard | |
| 4,838,734 | A | 6/1989 | Pinto | |
| 4,958,457 | A | 9/1990 | Doskocil | |
| 5,203,101 | A | 4/1993 | Bryan | |
| 5,315,770 | A | 5/1994 | Campbell | |
| 5,381,616 | A | 1/1995 | Disney | |
| 5,490,339 | A | 2/1996 | Accettola | |
| 5,575,538 | A | 11/1996 | Gilbert et al. | |
| 5,873,186 | A | 2/1999 | Yoder et al. | |
| 6,055,750 | A | 5/2000 | Yoder et al. | |
| 6,189,244 | B1 | 2/2001 | Johnson et al. | |
| 6,371,691 | B1 | 4/2002 | Finzel et al. | |
| 6,402,123 | B1 | 6/2002 | Rivard | |
| 6,467,201 | B1 | 10/2002 | McSharry et al. | |
| 6,637,978 | B1 | 10/2003 | Genta | |
| 6,718,660 | B2 | 4/2004 | Rivard | |
| 6,830,412 | B2 | 12/2004 | Perez | |
| 6,866,448 | B2 | 3/2005 | Finzel et al. | |
| 8,061,344 | B2 * | 11/2011 | Dofher | B28D 7/02 125/13.01 |
| 8,157,477 | B2 | 4/2012 | Horan et al. | |
| 8,333,435 | B2 * | 12/2012 | Stratti | E02F 9/2866 175/427 |
| 8,375,605 | B2 * | 2/2013 | Ruhl | E02F 3/183 37/907 |
| 8,806,784 | B2 * | 8/2014 | Ruhl | E02F 3/183 37/907 |
| 2004/0148823 | A1 | 8/2004 | Schenk | |
| 2006/0191526 | A1 * | 8/2006 | Markley | B23D 47/02 125/13.01 |
| 2007/0096539 | A1 * | 5/2007 | Walker | E01C 23/0933 299/39.3 |
| 2009/0007460 | A1 | 1/2009 | Greenlee et al. | |

* cited by examiner

FIG. 5A
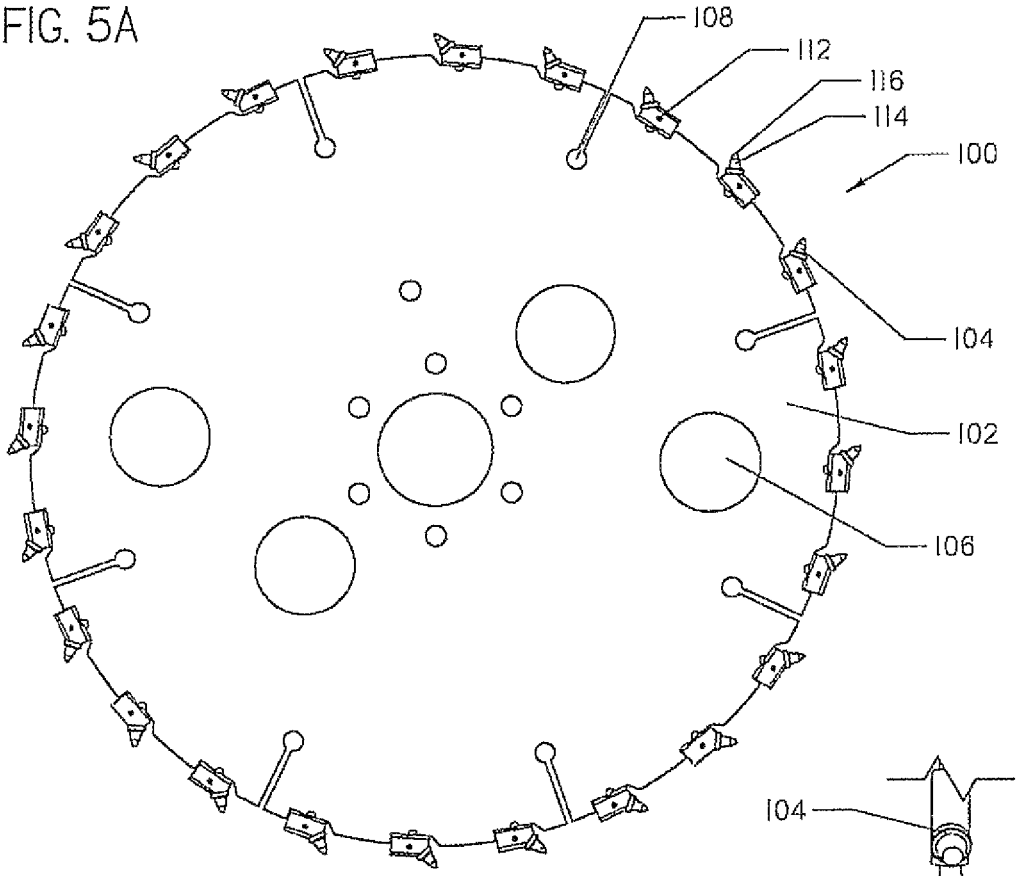
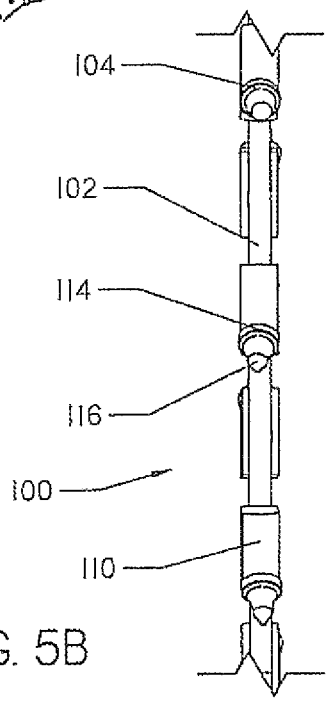
FIG. 5B

FIG. 6A
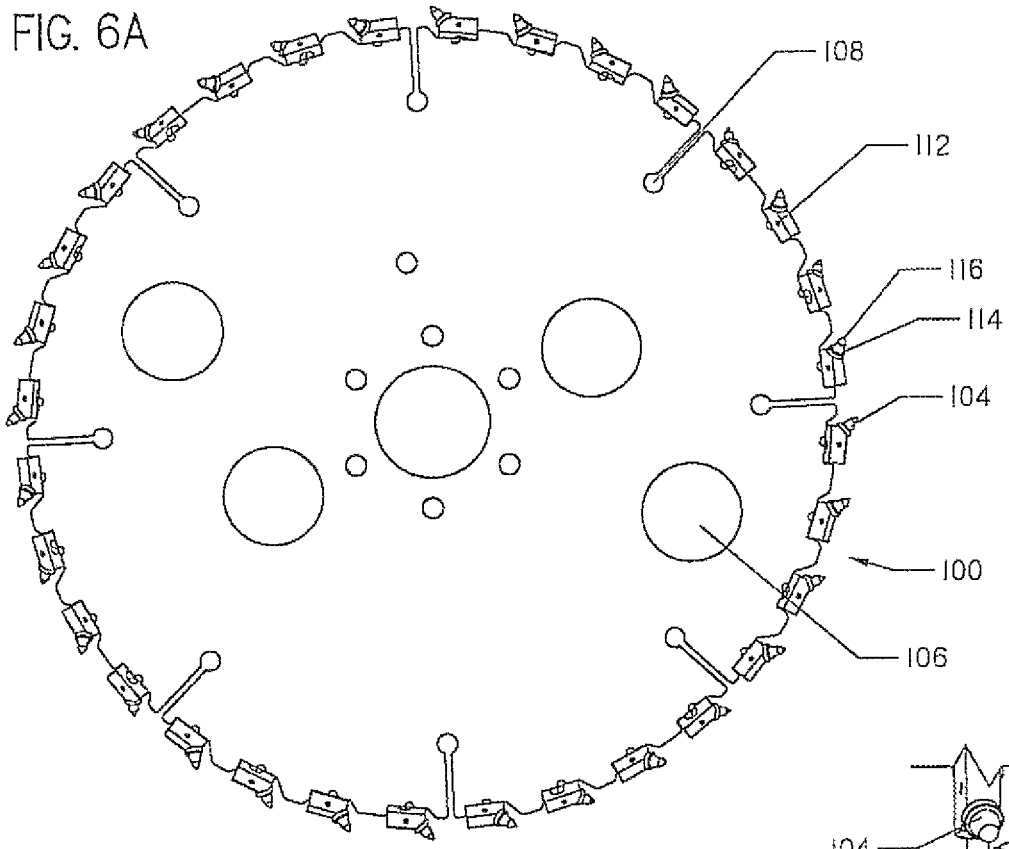
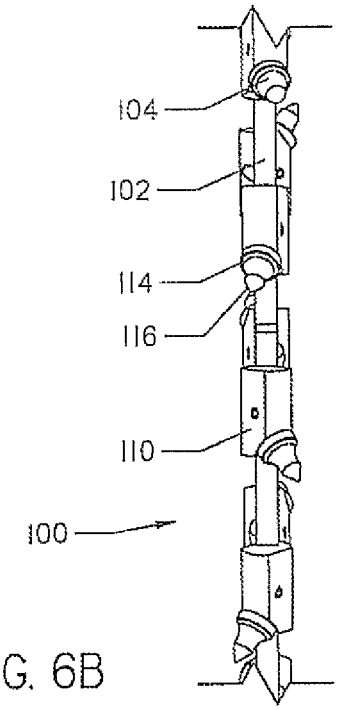
FIG. 6B

TRENCHING SYSTEM

CROSS REFERENCE TO RELATED APPLICATIONS

This application is a continuation of U.S. patent application Ser. No. 13/758,233, filed Feb. 4, 2013, now U.S. Pat. No. 8,806,784, issued Aug. 19, 2014, which is a continuation of U.S. patent application Ser. No. 12/842,799, filed Jul. 23, 2010, now U.S. Pat. No. 8,375,605, issued Feb. 19, 2013, which claims priority of U.S. Provisional Patent Application No. 61/227,935, filed Jul. 23, 2009, and U.S. Provisional Patent Application No. 61/353,984, filed Jun. 11, 2010, the contents of which are incorporated fully herein by reference.

FIELD

The present invention relates to the field of outdoor work machines and more particularly to systems for cutting and cleaning a narrow trench.

SUMMARY

The invention is directed to a trenching assembly for use with a work machine to cut a trench. The trenching assembly comprises a frame, a blade cover attached to the frame, a hub, a blade, and a cylinder assembly. The blade cover and the frame define a surface engaging member and a cavity. The hub is attached to the frame such that a vertical position of the hub relative to the frame is moveable. The blade is located substantially within the cavity and supported on the hub. The blade extends beyond the cavity. The cylinder assembly is operatively attached to the work machine and to the frame. Operation of the cylinder assembly manipulates an orientation of the surface engaging member about three axes relative to the work machine.

In another embodiment, a method for cutting a narrow trench in a surface. A rotatable blade is used. The rotatable blade is moveably attached to a frame and disposed within a cavity defined by a hood assembly. The hood assembly comprises a surface engaging member. The method comprises the steps of adjusting the blade relative to the surface engaging member to achieve a desired trench depth, rotating the blade to cut a trench, and positioning the surface engaging member on the surface adjacent the blade to stabilize a portion of the surface adjacent the trench.

In another embodiment, the invention is directed to a trenching assembly for use with a work machine. The trenching assembly comprises a surface engaging member, a means for moving the surface engaging member to contact a surface, and a rotatable blade. The rotatable blade cuts a trench through the surface. The surface engaging member is disposed about the rotatable blade and contacts a portion of the surface while the blade is cutting the trench to stabilize the surface adjacent the trench.

BRIEF DESCRIPTION OF THE DRAWINGS

FIG. 5A is a side view of a blade for use with the trench cutter attachment of FIGS. 1-4. The blade shown in FIG. 5A comprises cutting teeth disposed in a radial orientation.

FIG. 5B is a top view of the blade of FIG. 5A.

FIG. 6A is a side view of an alternative blade for use with the trench cutter attachment shown in FIGS. 1-4. The blade of FIG. 6A comprises cutting teeth disposed in an offset orientation.

FIG. 6B is a top view of the blade of FIG. 6A.

DETAILED DESCRIPTION

Figure 1:
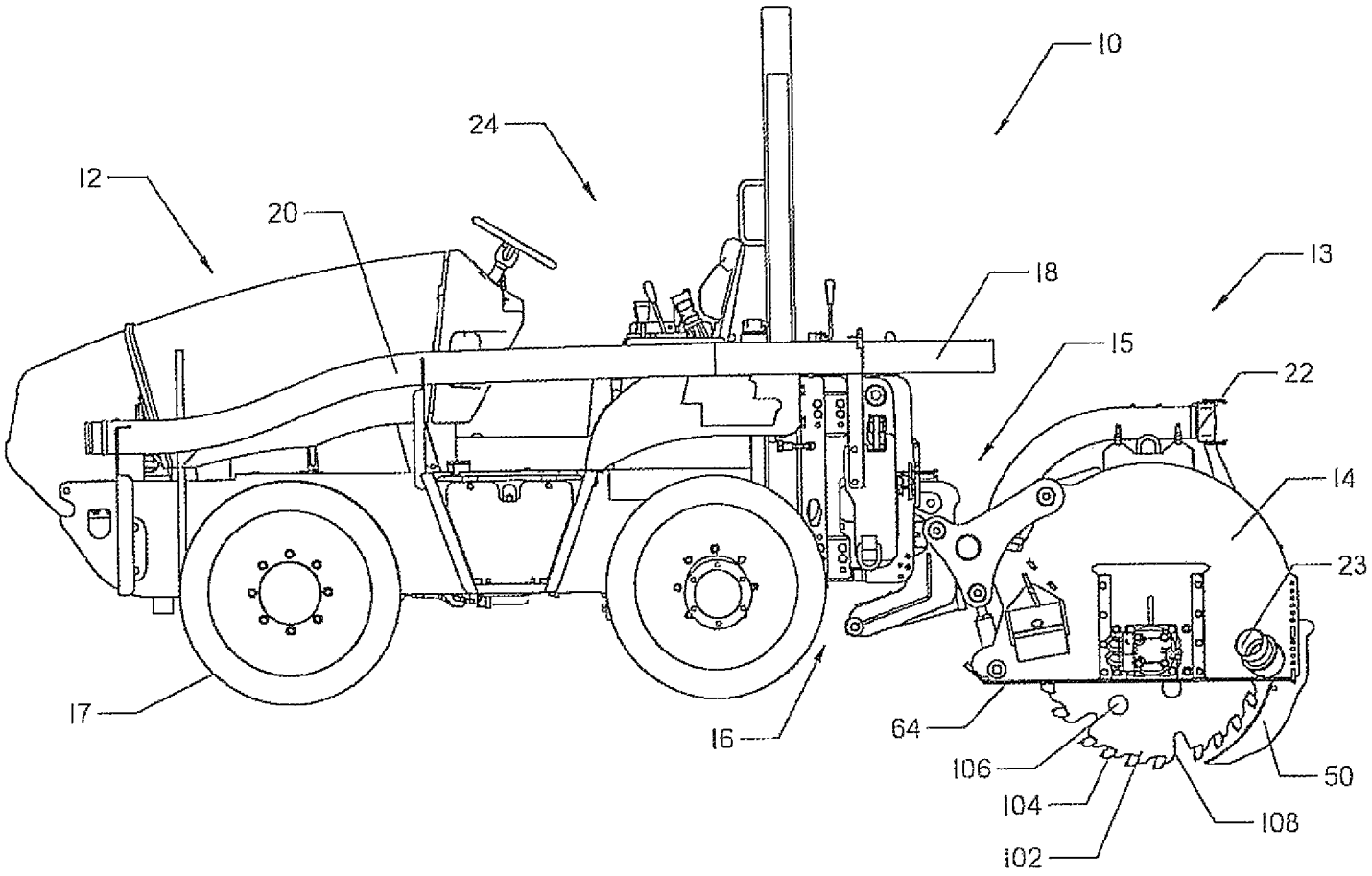
FIG. 1 is a side view of a tractor with a trenching assembly for use with a mobile system for cutting a trench.

Turning now to the drawings in general and FIG. 1 in particular, there is shown a mobile system 10 for cutting a narrow trench of varying depths and widths in a surface such as a concrete or asphalt roadway. The system 10 comprises a work machine 12 and a trenching assembly 13 attached to the work machine. The trenching assembly 13 comprises a frame 14 and a saw blade 100 rotatably mounted to the frame, which will be described in more detail below. The trenching assembly further comprises a cylinder assembly or linkage assembly 15 and an attachment frame 16. The work machine 12 may be any common tractor or work vehicle that can support the trenching assembly 13. The work machine 12 shown in FIG. 1 comprises a tractor having wheels 17, however, one skilled in the art will appreciated that a tracked vehicle or a pedestrian work machine may be used with the trenching assembly 13 of the present invention.

The system further comprises a vacuum system 18. As shown, the vacuum system 18 is mounted on the work machine 12 and on the trenching assembly 13 as an integrated single mobile unit. Alternatively, the vacuum system 18 may be a subsystem that can be controlled by the work machine 12 or remote control. The vacuum system 18 comprises a vacuum hose 20, a spoils inlet 22, and a vacuum power unit (not shown). Further, the vacuum system may comprise a cyclonic filtration system (not shown) to filter fine dust and increase power unit life. The spoils inlet 22 is attached to the trenching, assembly 13. As shown, a second spoils inlet 23 is also attached to the trenching assembly 13 near a trench cleaner 50. One skilled in the art can appreciate that one or more spoils inlets 22, 23 may be placed on the frame to efficiently remove accumulated spoils from the trenching assembly 13. In FIG. 1, portions of the vacuum hose 20 are not shown, but the hose should be understood to be continuous to each of the spoils inlets 22, 23. An operator station 24 is provided to control operation of the system 10.

Figure 2:
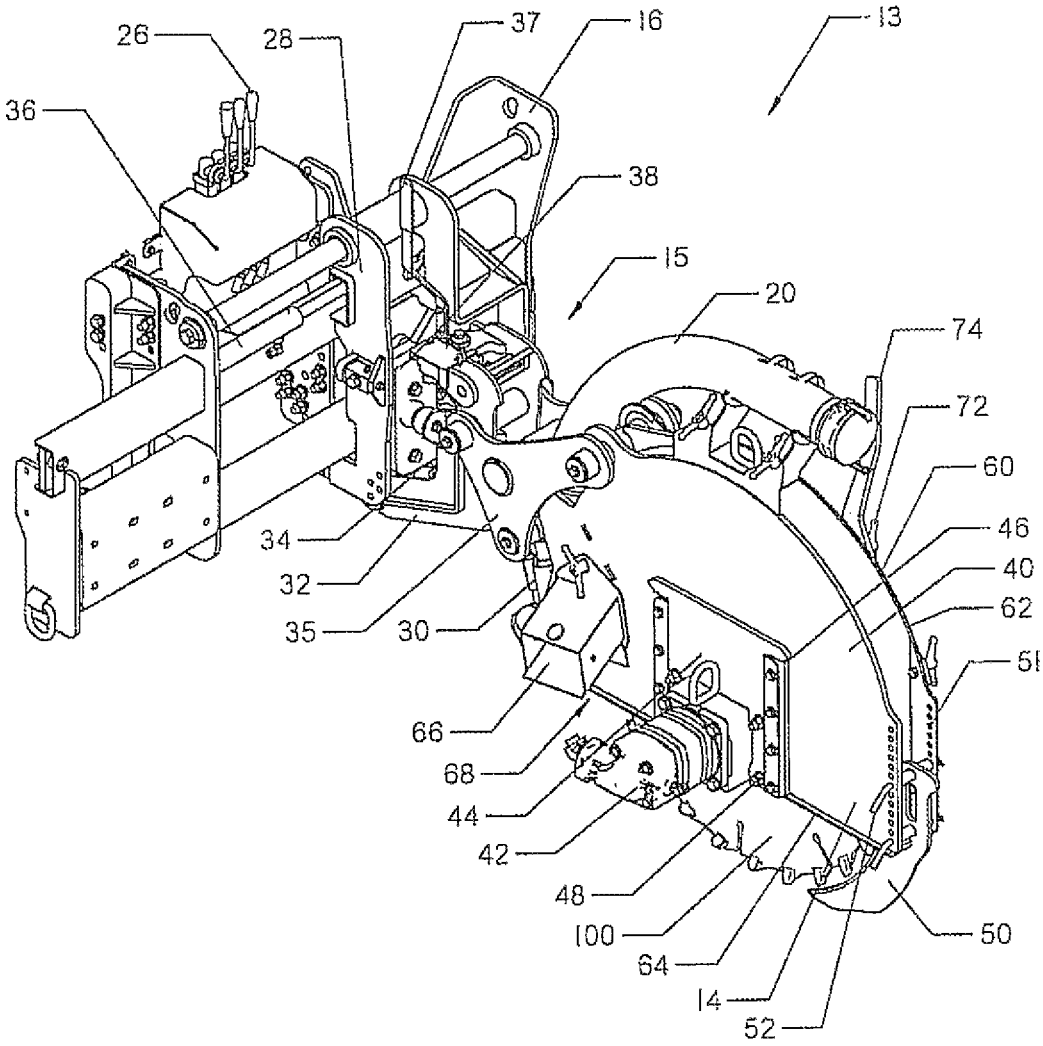
FIG. 2 is a side perspective view of a trench cutter attachment.

With reference now to FIG. 2, another embodiment of the trenching assembly 13 is shown. A control panel 26 is provided to control the trenching assembly 13. The attachment frame 16 is movably supported by the work vehicle 12 (not shown) and adapted to support the linkage assembly 15 and frame 14. The attachment frame 16 comprises a slide frame 28 adapted to traverse the length of the attachment frame. The linkage assembly 15 is adapted to manipulate the frame 14. The linkage assembly 15 comprises a level cylinder 30, a pivot frame 32, a lift cylinder 34, lift arms 35, a traverse cylinder 36, a swing lock 37, and a tilt plate 38. The linkage assembly 15 is mounted on the slide frame 28 such that the linkage assembly 15 may traverse the length of the attachment frame 16 by manipulation of the traverse cylinder 36. As shown, the frame 14 is mounted directly behind the back right tire 17. One skilled in the art could appreciate positioning the frame 14 in other positions relative to the attachment frame 16.

The level cylinder 30 attaches to the frame 14 at a first end and the lift arms 35 at a second end. Extension of the level cylinder 30 manipulates the level of the frame 14 from front to back. The lift cylinder 34 attaches to the pivot frame 32 at a first end and the lift arms 35 at a second end. Extension of the lift cylinder 34 allows for the frame 14 to be raised and lowered. The tilt plate 38 connects the pivot frame 32 to the slide frame 28 of the attachment frame 16. The tilt plate 38 allows the frame 14 to be tilted from side to side to compensate for crowning in a surface. The swing lock 37 secures the frame 14 in a fixed position substantially perpendicular to the attachment frame 16. The swing lock 37 may be unlocked to allow the frame 14 to swing from side to side to saw a curved trench. Thus the linkage assembly 15 utilizes cylinders 30, 34, 36 and other devices to manipulate the orientation of the frame 14. The orientation manipulated includes tilt, level, height from the surface, angle relative to the attachment frame 15, and position relative to the attachment frame 16. One skilled in the art could appreciate that other mechanisms such as additional cylinders and 4-bar linkages could be used to manipulate the orientation of the frame 14.

With continued reference to FIG. 2, the frame comprises a first panel 40, a motor assembly 42, and the motor plate 44. The first panel 40 is attached to the linkage assembly 15 via the lift arms 35 and the level cylinder 30. The first panel 40 provides structural stability needed to carry the blade 100 and motor assembly 42. As will be shown in FIG. 3, the first panel 40 of the frame 14 is adapted to connect to a removable cover 60.

The motor assembly 42 is mounted on the first panel 40. The motor assembly drives the blade 100. The motor assembly will be described in greater detail with reference to FIG. 4, below. With continued reference to FIG. 2, the motor assembly 42 has the capability of turning the blade 100 at variable RPM. The first panel 40 comprises a slot 46 and connection points 48. The motor plate 44 is adapted to be placed into the slot 46 and mounted at several positions on the first panel 40 using the connection points 48. As shown, the connection points 48 comprise bolts and bolt holes. The adjustment of the motor plate 44 changes a vertical position of the motor assembly 42 and blade 100 relative to the trenching assembly 13, and therefore, the maximum depth of the blade 100.

The trenching assembly 13 further comprises a trench cleaner 50 mounted on the frame. Preferably, the trench cleaner 50 is mounted on an end of the frame 14 and adjustable between a variety of depths. In a first position (not shown), the trench cleaner 48 is flipped and stored along the hood assembly 62 for when the blade 100 is not being used. In a second position, the trench cleaner 50 is adapted to extend into an exposed trench. A plurality of paired trench cleaner holes 51 and pegs 52 may be utilized to adjust the position and depth of the trench cleaner 50. The trench cleaner 50 is preferably of a width equal to or very slightly smaller than the width of any exposed trench cut by the blade 100.

Figure 3:
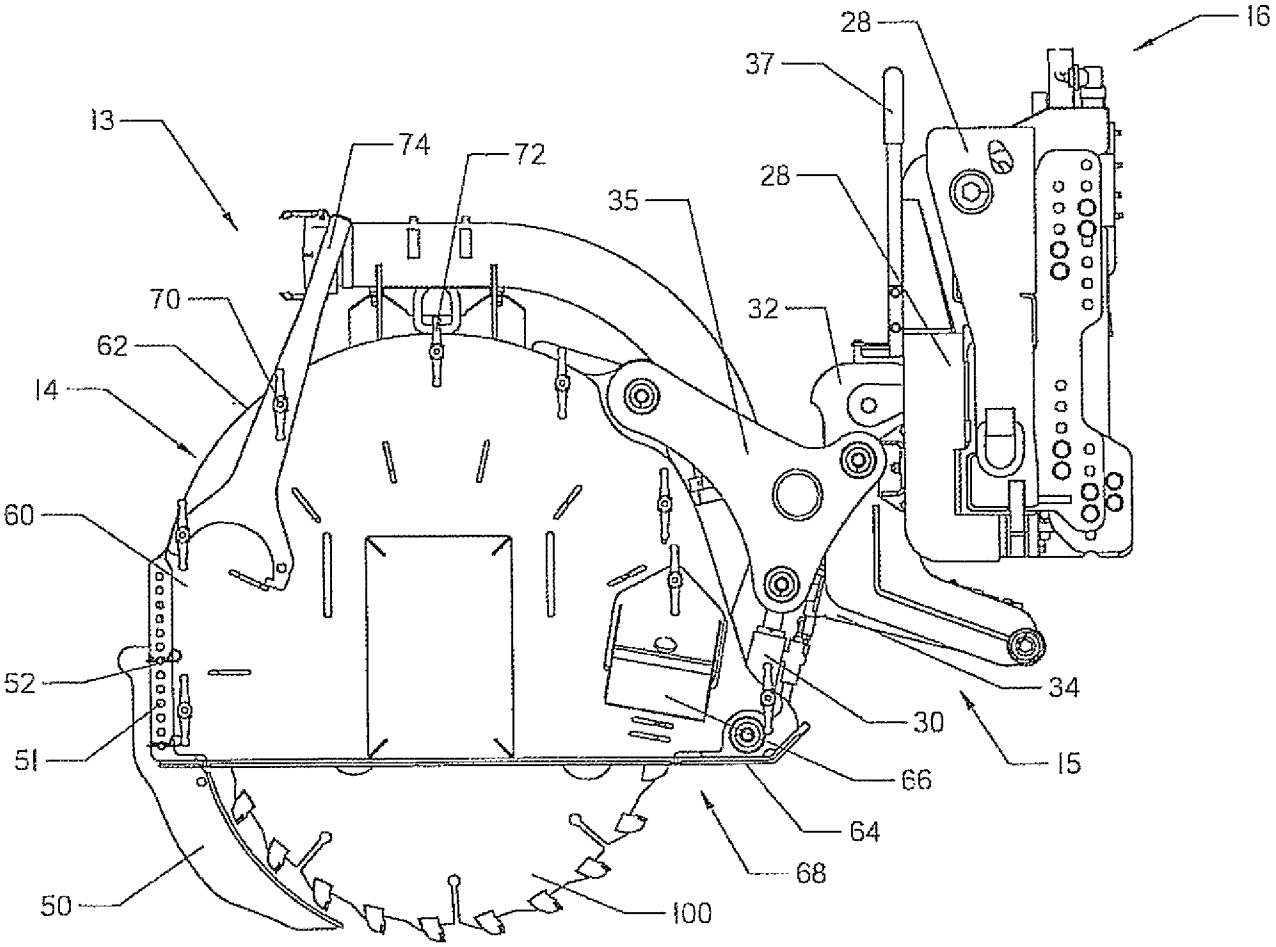
FIG. 3 is a side view of the trench cutter attachment.

With reference now to FIG. 3, the trenching assembly 13 is shown from an opposite side. The frame 14 may be connected to a removable blade cover 60 at the first panel 40. The first panel 40 (FIG. 2) and removable blade cover 60 form a hood assembly 62 having an internal cavity for surrounding the blade 100. The hood assembly 62 comprises a surface engaging member 64 and at least one spoils chute 66. The spoils chute 66 may be mounted on either side of the hood assembly 62 and when opened is adapted to direct spoils away from the uncovered trench.

The surface engaging member 64 is integral with or mounted on the bottom portion of the hood assembly 62 and thus located proximate a first end of the internal cavity. The surface engaging member 64 defines a perimeter around an opening 68 in the hood assembly 62. The surface engaging member 64 is composed of a durable material suitable for traversing concrete, asphalt, rock, or earth and forming a seal between the ground and the hood assembly 62. A means for moving the surface engaging member 64 to contact the surface being trenched manipulates the surface engaging member, enabling it to stabilize the surface. The means for moving the surface engaging member 64 may comprise the linkage assembly 15 or various hydraulic or mechanical actuators. The linkage assembly 15 generally, and the level cylinder 30 in particular, is connected to the frame 14 such that the opening 68 substantially seals the hood assembly 62 to the ground. Preferably, the level cylinder 30 and the surface engaging member 64 create downpressure proximate a path of the blade 100.

The frame 14 blade cover connections 70 mounted on the first panel 40. The blade cover connections 70 connect to corresponding holes on the removable cover 60 provide a quick method for removing the removable blade cover from the frame 14. As shown, the blade cover connections 70 are connected to the removable blade cover 60 by modified wing nuts 72, though alternative methods of removing and connecting the removable blade cover 60 to the frame 14 are envisioned. A wrench 74 for removing the blade 100 is shown mounted on the trenching assembly 13.

Figure 4:
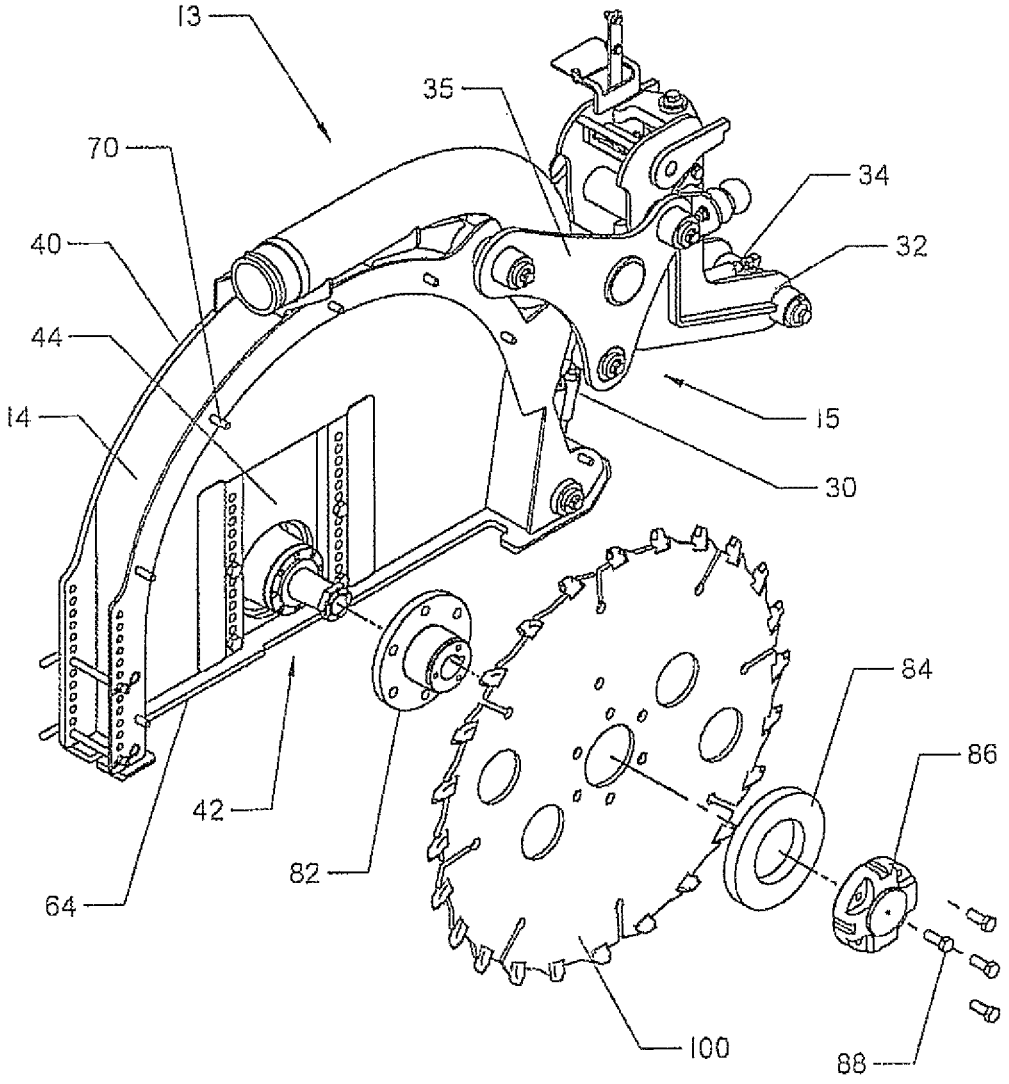
FIG. 4 is an exploded view of a motor assembly for the trench cutter attachment.

With reference now to FIG. 4, the motor assembly 42 of FIG. 2 is shown in exploded view with the removable blade cover 60 removed. The motor assembly 42 is mounted on the first panel 40 supported on the frame 14. The motor assembly 42 comprises a motor 80, threaded hub 82, spacing washer 84, a nut 86 and locking bolts 88. The hub 82 is supported on the frame 14. As shown, the hub 82 is supported on the motor 80 which is supported by the motor plate 44, which is supported by the frame 14. The hub 82 is adapted to fit over a shaft of the motor 80. The saw blade 100 is adapted to slide onto the hub 82 along with a spacing washer 84. The nut 86 is adapted to screw onto the threaded hub 82 to secure the blade 100 and washer 84. Locking bolts 88 are utilized to prevent the nut 86 from coming loose during rotation of the hub 82 and motor 80. Preferably, changing of the blade 100 requires minimal tools to disconnect the blade to the motor assembly 42. The wrench 74 is adapted to quickly remove and replace components of the motor assembly 42. One skilled in the art will appreciate that the wing nuts 72 and wrench 74 may be utilized to fully remove and replace the blade 100 from the trenching assembly 13. In this way a replacement blade 100 may be utilized without removing the system from the worksite.

As shown in FIG. 1, the vacuum system 18 may be mounted such that at least one vacuum inlet 22, 23 is proximate the trench cleaner 50. The vacuum hose 20 may extend beyond the hood assembly 62 and into the trench along with the trench cleaner 50. In this way, loosened spoils in the trench that are between the trench walls, trench cleaner 50 and blade 100 are directly removed from the trench.

The blade 100 will be discussed in more detail. The blade 100 is located substantially within the hood assembly 62 and supported on the frame 14. The blade 100 extends beyond the opening 68 in the hood assembly 62. The blade 100 comprises a disc portion 102 and a plurality of teeth 104. As shown in FIG. 1, the disc portion 102 is generally circular and uniform, but may comprise openings 106 and cutout portions 108 to decrease the friction, decrease the weight of the blade 100 and further help remove spoils from the trench. During operation, the blade 100 may increase in temperature. The cutout portions 108 may also help to mitigate the effects of thermal expansion of the blade 100. Additionally, a cooling agent such as air, water, or foam may be applied to the blade 100 to prevent thermal expansion. The disc portion 102 defines a circumference and a width, and may contain dimples (not shown) to further reduce drag dining rotation of the blade 100. The disc portion 102 may be of varying widths, such as 1.5 inches or less.

With reference now to FIG. 5A, a first configuration, or radial position of the blade 100 is shown. The blade 100 comprises the disc portion 102, the teeth 104, at least one bit block 110 and at least one roll pin 112. The bit blocks 110 may be rotated and welded to the disc portion 102 in varying radial positions and roll angles. Each tooth 104 is secured to the bit block 110 by the roll pin 112. The tooth 104 comprises a rotating bit 114 and a tip 116. The position of each tooth 104 is directed by the angle that each bit block 110 is rotated with respect to the disc 102. In the radial position shown in FIG. 5B, the teeth do not breach the plane defined by a width of the disc portion 102. The tip 116 is preferably a durable carbide, diamond, or similar material, and conical in shape. Carbide tips 80 are best suited when the motor 80 is operating at lower RPM. Diamond tips 116 on the bits 114 are best suited when the motor 80 is operating at higher RPM.

With reference now to FIG. 6A, a second configuration, or offset position of the blade 100 is shown. As can be seen in FIG. 6B, each of the plurality of teeth 104 breach the plane defined by the width of the disc portion 102 in one direction or the other. One skilled in the art will appreciate that a trench cut by a blade 100 in the offset position will be wider than a trench cut by the same or similar blade in the radial position. Thus, various offset positions may be utilized to customize the width of a trench desired.

As shown, the teeth 104 are of a modular nature and are detachable to the blade 100. Modular, detachable components are easier to replace and ship when worn.

The system 10 can be used in combination with other trenching techniques. For example, the system 10 may cut through a hard surface, but at too shallow a depth. Thus, other trenching systems, such as a vibratory plow, can follow behind the system to cut the trench and install the product deeper but without excessive wear to the other trenching system.

Figure 7:
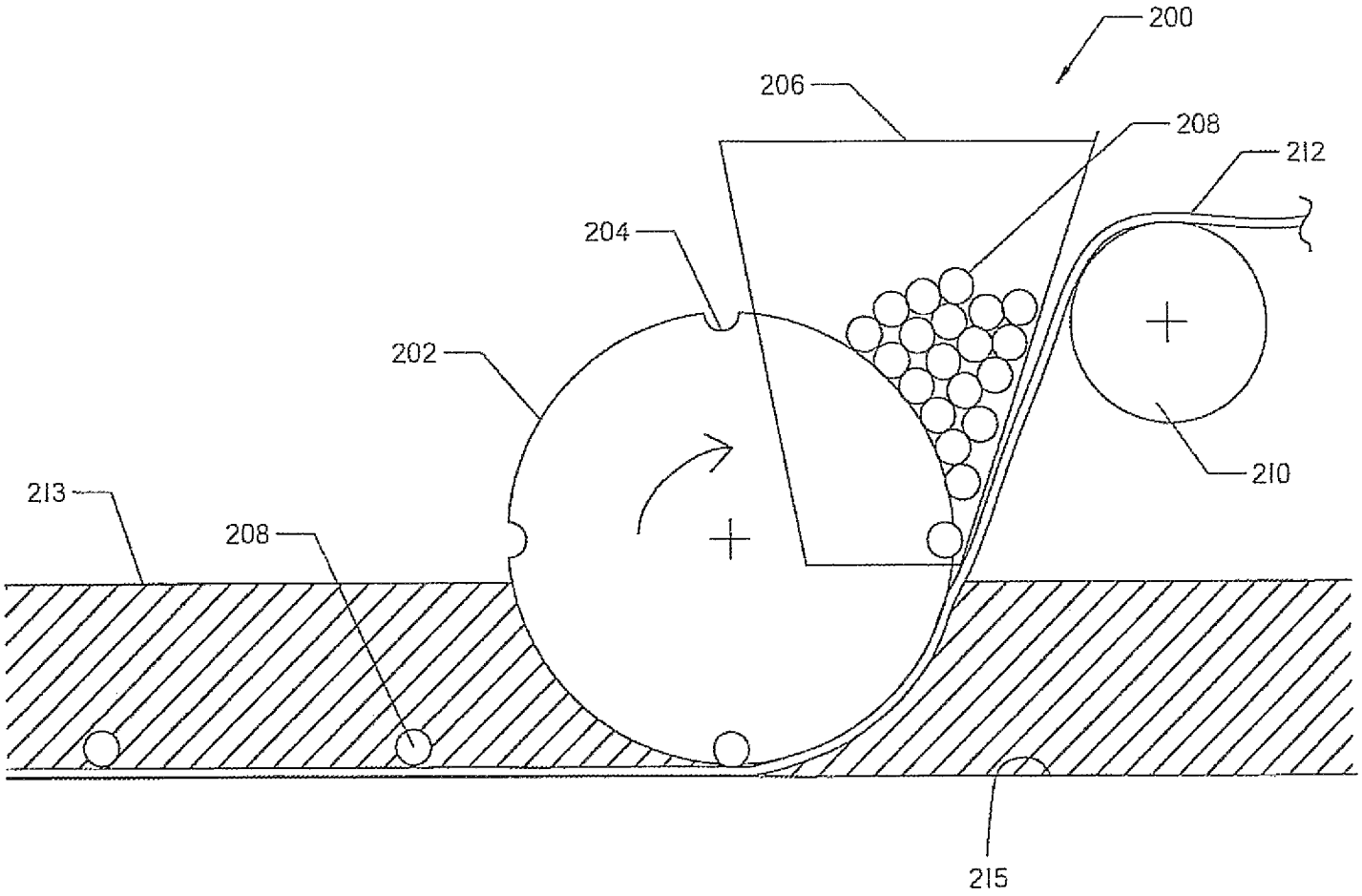
FIG. 7 is a diagrammatic representation of a system for inserting product into a trench cut using the system shown in FIGS. 1 through 6B.

With reference now to FIG. 7, a system 200 for inserting product into the trench 213 is shown. The system 200 comprises a wheel 202 defining at least one notch 204, a hopper 206, at least one deformable ball 208 contained within the hopper, and guides and rollers 210 for feeding a product line 212 into the trench 213. Further, one will understand that the system 200 also comprises a means for moving the system such as a tractor similar to the one shown in FIG. 1. The wheel 202 has a radius larger than the trench depth. As the system 200 is moved along the trench, the notch 204 picks up a ball 208 removed from the hopper 206. The ball 208 is trapped between the wheel 202 and the product 212 and is carried by the wheel to a bottom 215 of the trench. As the wheel 202 continues to roll along the trench, the ball 208 is left in the bottom 215, holding the product 212 in place until the trench can be filled and sealed with a grout or other acceptable material. Alternatively, deformable bulges (not shown) could be molded into the product 212 at fixed intervals to perform the function of the deformable balls 208.

The system 10 may further comprise an apparatus for sealing a trench (not shown). The trench can be sealed with any typical sealant such as grout or concrete. Such a system is sold by K-2 Manufacturing, Inc. under the trade name Grout King™.

One skilled in the art will appreciate that the system 10 comprises several discrete subsystems, such as the vacuum system 18, the system for placing product 200, the apparatus for sealing a trench, etc. Each of these subsystems may be controlled at the operator station 24 located on the work machine 12. Alternatively some or all of the subsystems may be remotely controlled.

In operation, the system 10 is adapted to cut a trench in a surface. The blade 100 is provided and mounted to the trenching assembly 13 at the hub 82. Preferably, a blade 100 is chosen where the plurality of teeth 104 are in either the radial or the offset position depending on the desired width of trench. The hood assembly 62 is assembled and the hub 82 and blade 100 are raised or lowered by the motor plate 44 to achieve a desired trench depth. The blade 100 is rotated to cut a trench and the at least one cylinder 30, 34, 36 and linkage assembly 15 are adjusted to achieve a substantial seal between the surface engaging member 64 and the surface being trenched. The vacuum system 18 is activated to remove spoils at the vacuum inlet 22, 23. The trench cleaner 50 provides a channel for the removal of spoils from within the trench.

As work machine 12 moves across the surface, the trenching assembly 13 may be adjusted by linkage assembly 15 and cylinders 30, 34, 36 to maintain the substantial seal between the surface engaging member 64 and the surface being trenched over uneven terrain. The level cylinder 30 provides downpressure on the surface proximate a path being trenched by the blade 100. The downpressure of the surface engaging member 64 coupled with the rotation of the blade 100 stabilizes the surface and creates a "scissor" effect when cutting the trench. Therefore, the surface engaging member 64 stabilizes a portion of the surface adjacent to the trench and avoids breakout of the surface, such as asphalt pavement, being trenched. By avoiding breakout, the trench is given straighter, more uniform edges and a smaller average width.

Product 212 may then be placed within the uncovered trench using the system for inserting product 200. The trench may then be covered by a sealing machine (not shown) trailing the system 10 and sealing the trench with concrete or grout.

Various modifications can be made in the design and operation of the present invention without departing from the spirit thereof. Thus, while the principal preferred construction and modes of operation of the invention have been explained in what is now considered to represent its best embodiments, which have been illustrated and described, it should be understood that the invention may be practiced otherwise than as specifically illustrated and described.

What is claimed is:

1. A method for cutting a narrow trench in a surface using a rotatable blade moveably attached to a frame and disposed within a cavity defined by a hood assembly, the hood assembly comprising a surface engaging member, the method comprising:

adjusting the blade relative to the surface engaging member to achieve a desired trench depth;

rotating the blade to cut a trench;

positioning the surface engaging member on the surface adjacent the blade; and applying a downpressure greater than the weight of the hood assembly to the surface bordering the trench at the surface engaging member.

2. The method of claim 1 further comprising:

substantially sealing the cavity and the trench with the surface engaging member; and applying a vacuum within the cavity to remove spoils from the cavity and the trench.

3. The method of claim 2 wherein the trench is less than 1.5 inches in width.

4. The method of claim 2 further comprising placing a product within the trench.

5. The method of claim 4 further comprising sealing the trench after the product has been placed within the trench.

6. The method of claim 1 wherein a plurality of saw blades having rotatable teeth adjustable between a radial position and an offset position are provided, the method further comprising choosing a saw blade based on a desired trench width.

7. The method of claim 6 further comprising moving at least one of the plurality of rotatable teeth between a radial position and an offset position relative to the saw blade.

8. The method of claim 1 wherein downpressure is provided to the portion of the surface adjacent the trench at the surface by a cylinder assembly.

9. A trenching assembly for creating a narrow trench through an existing surface disposed over a subsurface below the existing surface, the assembly comprising:

a blade assembly comprising a blade to cut through the existing surface and into the subsurface to create a trench having a width less than 1.5 inches;

a hood assembly covering at least a portion of the blade;

a surface engaging member provided on the hood assembly proximate the blade; and a hydraulic cylinder supported by the housing and configured to apply downpressure eater than the weight of the hood assembly against the surface bordering a trench.

10. The trenching system of claim 9 further comprising a grouting assembly for substantially sealing the trench in the existing surface.

11. The trenching system of claim 9 wherein a cutting depth of the blade assembly is adjustable relative to the existing surface.

12. The trenching assembly of claim 9, further comprising:

a vacuum system connected to the hood assembly.

13. A trenching assembly for use with a work machine to cut a narrow trench in a surface, the trenching assembly comprising:

a hood assembly, moveable relative to the work machine, comprising a surface engaging member; and a rotatable blade disposed within the hood assembly to cut the trench;

wherein the surface engaging member is positioned to the side of the rotatable blade and wherein the surface engaging member is biased against the surface and applies a downpressure greater than the weight of the hood assembly to the surface bordering the trench while the blade is cutting the trench.

14. The trenching assembly of claim 13 wherein the rotatable blade comprises a plurality of teeth, at least one of the plurality of teeth moveable from a first position to a second position.

15. The trenching assembly of claim 13 wherein the trench has a width of less than 1.5 inches.

16. The trenching assembly of claim 13 further comprising:

a vacuum system; and a vacuum hose extending between the vacuum system and the hood assembly, wherein the vacuum system is not situated on the hood assembly.

17. The trenching assembly of claim 16 further comprising removing spoils away from the blade through the vacuum hose.

18. The trenching assembly of claim 13 further comprising a linkage assembly for connection to a work machine, wherein the surface engaging member may be biased downward by the linkage assembly.

19. A trenching assembly for cutting a narrow trench in a surface, comprising:

a hood assembly, having a planar lower surface in which an opening is formed, the opening characterized by an enclosed shape entirely framed around its perimeter by the lower surface;

a rotatable blade at least partially positioned within the hood assembly, in which the blade extends through the opening; and equipment configured to provide a downpressure greater than the weight of the hood assembly to a surface adjacent a narrow trench.

20. The trenching assembly of claim 19, further comprising:

a vacuum system, comprising:

a vacuum hose; and the hood assembly, further comprising:

a port formed in the hood assembly in which the vacuum hose attaches to the hood assembly via the port.

21. The trenching assembly of claim 19, further comprising:

a linkage assembly, comprising:

a support frame; and a linear actuator having a first end attached to the support frame and a second end attached to the hood assembly.

22. The trenching assembly of claim 21 in which the linear actuator is a cylinder assembly.

23. A system, comprising:

the trenching assembly of claim 21; and a trench formed in the ground in which the cutting blade is partially positioned within the trench and in which the linkage assembly presses the lower surface into the ground.

24. A trenching assembly for use with a work machine to cut a trench in a surface, the trenching assembly comprising:

a hood assembly, moveable relative to the work machine, comprising a surface engaging member; and a rotatable blade disposed within the hood assembly to cut the trench;

wherein the surface engaging member is positioned to the side of the rotatable blade;

wherein the surface engaging member is biased against the surface while the blade is cutting the trench; and wherein the hood assembly is moveable about three axes relative to the work machine.

25. A system, comprising:

a trenching assembly, comprising:

a hood assembly, having a planar lower surface in which an opening is formed, the opening characterized by an enclosed shape entirely framed around its perimeter by the lower surface;

a rotatable blade at least partially positioned within the hood assembly, in which the blade extends through the opening;

a linkage assembly, comprising:

a support frame; and a linear actuator having a first end attached to the support frame and a second end attached to the hood assembly; and a vacuum hose; and a trench formed in the ground in which the blade is partially positioned within the trench, in which the linkage assembly presses the lower surface into the ground, and in which the vacuum hose extends through the housing into the trench.

* * * * *